United States Patent [19]

Swoager

[11] 4,058,104

[45] Nov. 15, 1977

[54] HYDROSTATIC BEARING PISTON FOR A TWO-CYCLE ENGINE

[75] Inventor: Jon R. Swoager, Imperial, Pa.

[73] Assignee: Automation Equipment, Inc., Imperial, Pa.

[21] Appl. No.: 570,783

[22] Filed: Apr. 23, 1975

[51] Int. Cl.[2] ..... F02F 1/00

[52] U.S. Cl. ..... 123/193 CP; 92/160

[58] Field of Search ..... 123/193 R, 193 P, 193 CP, 123/73 A; 92/158, 160; 184/18

[56] References Cited

U.S. PATENT DOCUMENTS

| | | | |
|---|---|---|---|
| 1,432,799 | 10/1922 | Stackhouse | 123/193 P |
| 1,531,066 | 3/1925 | Brice | 123/73 A |
| 1,665,438 | 4/1928 | Brower | 92/160 |
| 1,787,638 | 1/1931 | Moore | 92/160 |
| 2,119,633 | 6/1938 | Edwards | 184/18 |
| 2,857,218 | 10/1958 | Pachernegg | 92/160 |
| 2,921,823 | 1/1960 | Kestler | 92/160 |
| 3,667,443 | 6/1972 | Currie et al. | 123/193 P |
| 3,815,558 | 6/1974 | Tenney | 123/73 A |

*Primary Examiner*—Ronald H. Lazarus
*Assistant Examiner*—David D. Reynolds
*Attorney, Agent, or Firm*—Robert D. Yeager; Howard G. Massung

[57] ABSTRACT

A two-stroke engine having an improved piston construction which reduces friction and wear between the piston and the cylinder wall, thereby providing cooler operation at any selected speed. The decreased wear increases piston life. The piston skirt, which is substantially parallel to the cylinder wall during normal operation, has a plurality of circumferentially spaced openings formed therethrough. These circumferentially spaced apart openings or holes, which are of a relatively small cross-sectional area compared with the area of the ports, are aligned with vertical continuous portions of the cylinder wall. The openings of the inlet, outlet, and transfer ports are located between the vertical continuous portions or ribs of the cylinder. The piston is disposed within the hollow inner portion of the cylinder for relative reciprocating motion. The openings in the cylinder skirt are aligned to move along the vertical ribs. As the piston reciprocates, the holes permit the fuel-air mixture in the crankcase to form a hydrostatic-type bearing between the piston and the cylinder wall. The disclosed bearing drastically reduces friction and results in substantially lower operating temperatures for the engine and provides reduced piston and cylinder wall wear. The openings through the piston skirt should generally be uniformly spaced around the skirt to provide for a uniform loading on the piston. Normally, the holes in the piston skirt will be formed in 180° spaced apart pairs. It has been determined that three pairs, six holes, uniformly spaced around the piston skirt provide for good operating performance. More than one set of circumferentially spaced holes can be utilized in the piston skirt. Additional sets of circumferentially spaced bores can be vertically separated. Excellent operation can be obtained with three sets of vertically aligned and circumferentially spaced apart bores through the cylinder skirt.

8 Claims, 7 Drawing Figures

HYDROSTATIC BEARING PISTON FOR A TWO-CYCLE ENGINE

BACKGROUND OF THE INVENTION

1. Field of the Invention

This invention relates to a two-stroke internal combustion engine and more particularly to an improved piston construction particularly suitable for use on a crankcase scavenged two-stroke engine.

2. Description of the Prior Art

The two-stroke internal combustion engine due to its few number of moving parts and simple rugged construction has been used as a power source in many applications. A piston is disposed within a cylinder for relative reciprocating motion. As the piston moves, it periodically covers and uncovers ports in the cylinder wall which provide releases for the exhaust gases and feed fresh fuel-air mixtures into the cylinder. In a crankcase scavenged two-stroke engine, the crankcase is sealed and functions as a pump in conjunction with the piston to feed a fresh fuel-air mixture into the cylinder. During normal operation when the piston ascends, a slight vacuum is produced in the crankcase until the lower edge of the piston skirt passes the inlet port permitting a fresh fuel-air mixture to be drawn into the sealed crankcase. A transfer passage having an opening in the crankcase and in the cylinder is utilized for moving the fresh fuel-air misture from the crankcase into the cylinder as the piston descends. With the piston in the proper position the transfer passage provides free communication between the crankcase and the cylinder. As the piston descends, the fuel-air mixture in the crankcase is slightly compressed so that when the top of the piston releases the transfer ports opening into the cylinder the fresh fuel-air mixture passes into the cylinder. As the piston descends, due to the pressure caused by the hot burnt gases, exhaust ports in the cylinder are uncovered through which the exhaust gases can pass. As the fresh fuel-air mixture enters the cylinder from the crankcase the remaining burnt gases are forced out the exhaust ports. The inlet, exhaust, and transfer ports, normally utilize a plurality of openings formed in the cylinder walls. These ports are vertically aligned and circumferentially spaced apart in the cylinder wall. Vertical continuous wall portions or ribs are formed between the circumferentially spaced ports.

Extensive work has been carried out on piston development to eliminate specific problems. U.S. Pat. No. 1,673,775 illustrates an anti-detonation piston head formation for internal combustion engines. This construction shows a plurality of holes formed in an angled portion of the cylinder skirt which are perhaps provided as drain holes for oil scraped from the cylinder wall by the sealing rings. The use of these holes is not discussed in U.S. Pat. No. 1,673,775 and they could not operate to provide a hydrostatic bearing surface as provided in the present disclosure.

Several prior art patents such as U.S. Pat. No. 1,896,124; 2,013,983; 2,151,291; and 2,151,698 illustrate piston constructions having hollow chambers formed therein through which a cooling gas or a gas to be heated is passed. The openings into the hollow chambers are relatively large and they could not function to provide the advantages of the piston described in the instant application. U.S. Pat. No. 1,953,109 discloses a piston having a sealed hollow chamber formed therein through which relatively large elongated oil collection ducts pass. The sealed chamber is provided with a cooling medium disposed therein to provide for cool operation of the piston.

U.S. Pat. No. 3,161,188 teaches a piston construction having cooling passageways formed in the piston head. The passageways are formed of inner-communicating bore holes skewed relatively to the longitudinal axis of the piston. Passages extend from the external piston skirt, through the skirt, into an opening in the inner portion of the piston and into the piston head. Oil is force squirted beneath the piston skirt into the cooling channels. The portion of the bore through the piston skirt is only formed for ease of construction. A drainage groove is provided on the external surface of the piston skirt to drain away any oil which passes through the bore of the piston skirt. The internal surface of the piston is formed to prevent or minimize any oil passing through the bore in the piston skirt.

U.S. Pat. No. 3,667,443 teaches an internal combustion engine with pistons having vent openings connecting the space between the first and second piston rings with the engine crankcase, to vent hydrocarbon-rich gases to the crankcase. A plurality of radial oil drain holes are also provided in the piston connecting the base of the third ring groove with the piston interior to provide for direct return to the crankcase of oil scraped from the cylinder walls.

A continuing problem with prior art two-stroke engines has been the generation of excessive heat in the cylinder and pistons. This limits the maximum permissible RPM's as well as reduces the volumetric efficiency of a crankcase scavenged engine. Excessive heat in the piston can also cause piston deterioration and failure of the sealing rings.

SUMMARY OF THE INVENTION

The disclosed invention teaches a two-stroke engine having an improved piston construction which reduces heating of the piston and cylinder and permits an increase in the maximum permissible RPM's. The disclosed piston comprises a piston head from which a solid piston skirt extends, which during normal operation is approximately parallel with the inner cylinder wall. At least one annular groove for receiving a sealing ring is formed at the upper end of the piston skirt. If desired more than one sealing ring groove can be formed. Beneath the sealing ring grooves, a pair of circumferentially spaced apart holes or bores are formed through the solid piston skirt. These bores or openings in the piston skirt are aligned to register with the vertical ribs or continuous portions of the cylinder wall. Between the vertical ribs various port openings are formed. The piston is supported within the cylinder; and, thus with the bores aligned with the ribs of the cylinder wall during operation, the openings reciprocate up and down along the vertical ribs or continuous portions of the inner cylinder wall. The bores are normally formed in 180° spaced apart pairs. The bores formed in the piston skirt can be provided approximately perpendicular to the cylinder wall. These spaced apart bores have a relatively small area as compared with the area of the port openings. As the piston reciprocates the holes permit the fuel-air mixture in the crankcase to form a hydrostatic-type bearing surface between the piston and the associated cylinder wall. The disclosed piston construction reduces wear between the cylinder wall and piston. Normally the hydrostatic bores are formed at uniform intervals around the piston to insure equal loading in all four quadrants on the piston. If there are an odd number of vertical ribs in the piston the bores should be formed to minimize unbalanced loading of the associated piston.

It has been determined that the optimum number of holes spaced circumferentially around the piston skirt is six. Thus six circumferentially spaced bores can form one set. More than one set of circumferentially spaced holes can be utilized if desired. Additional vertically spaced apart sets of bores can be provided. Excellent results have been obtained with three sets of vertically separated bores wherein each set comprises six circumferentially spaced apart openings.

It is an object of this invention to teach a piston for a two-stroke engine having a plurality of circumferentially spaced apart bores formed through the solid skirt of the piston, beneath the sealing groove, to provide for reduced friction during operation.

It is a further object of this invention to teach a piston for a two-stroke engine having a plurality of holes formed below the sealing rings which are aligned with the vertical continuous portion or ribs of the associated cylinder.

BRIEF DESCRIPTION OF THE DRAWINGS

For a better understanding of the invention, reference may be had to the preferred embodiment exemplary of the invention shown in the accompanying drawings in which.

DESCRIPTION OF THE PREFERRED EMBODIMENT

Figure 1:
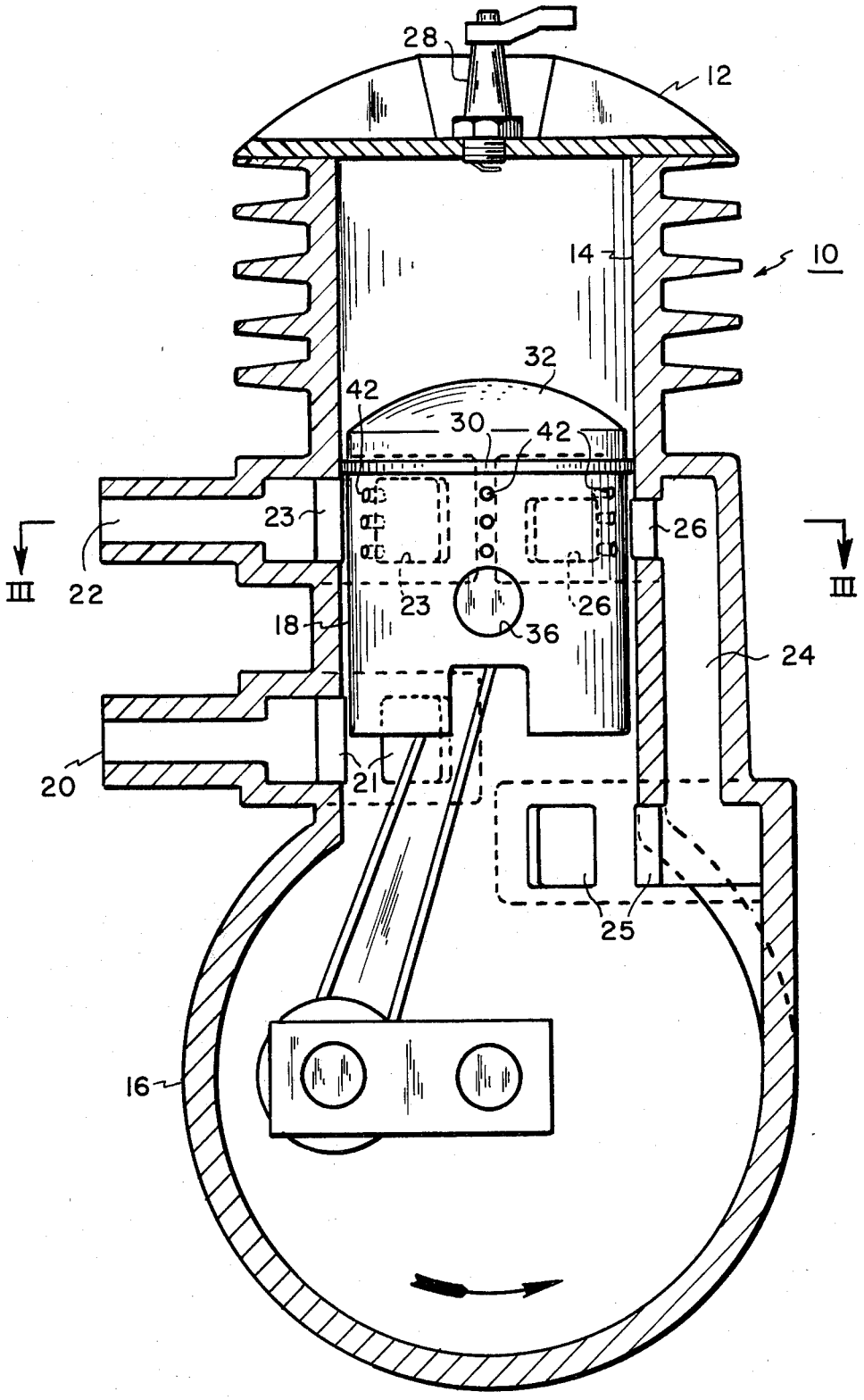
FIG. 1 is a side sectional view of a two-stroke crankcase scavenged engine.
Figure 2:
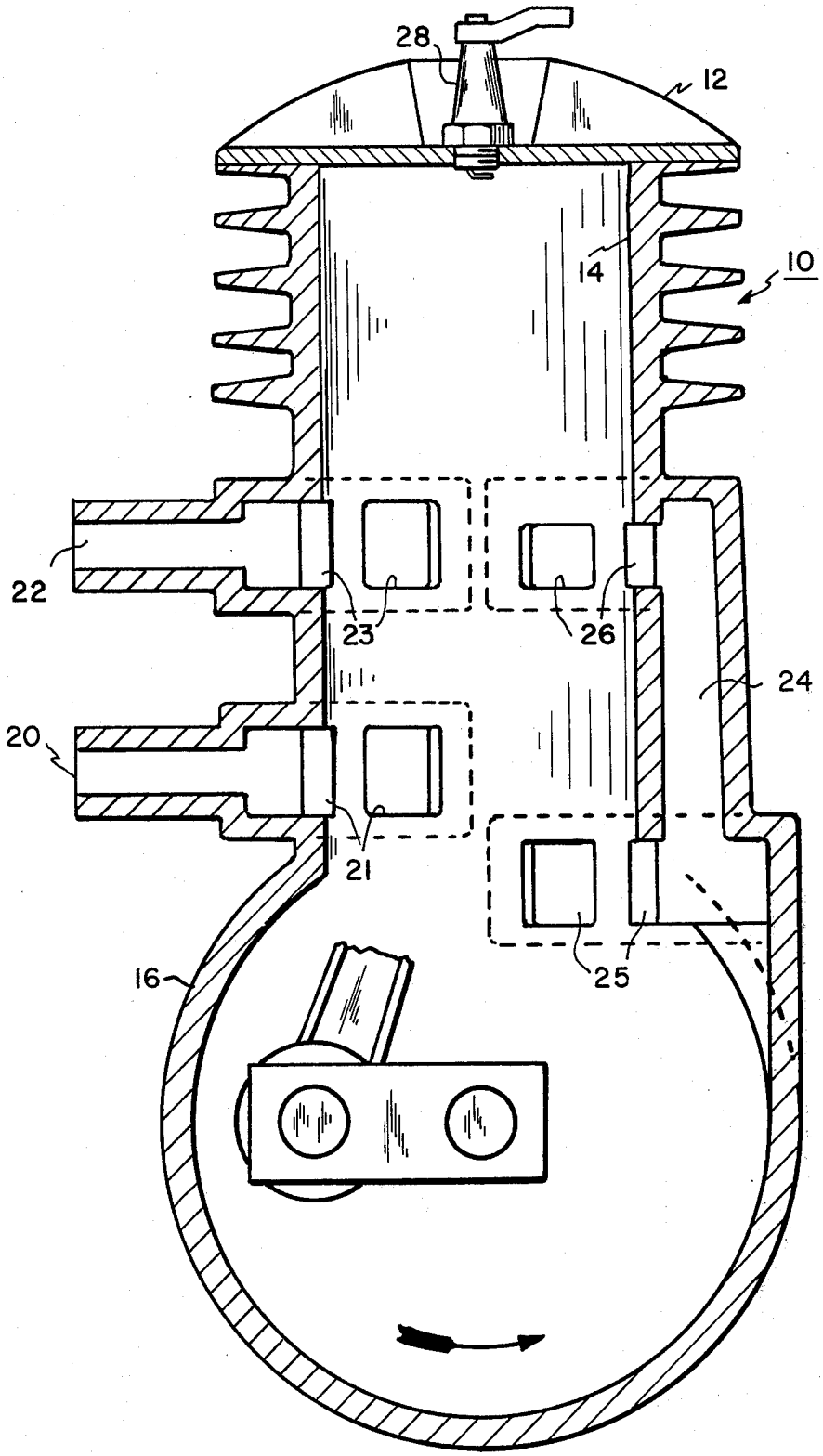
FIG. 2 is similar to FIG. 1 but with the piston removed for clarity.

Referring now to the drawings and FIGS. 1, 5, 6 and 7 in particular, there is shown a crankcase scavenged two-stroke engine 10 utilizing the teachings of the present invention. Two-stroke engine 10 comprises a cylinder head 12, a cylinder 14 and a crankcase 16. A reciprocating piston 18 is disposed within cylinder 14 for reciprocating motion. An inlet 20 is provided for introducing fresh fuel-air mixture into the crankcase 16 of engine 10. Burnt gases are ejected through exhaust outlet 22. A transfer passage 24 is provided between the crankcase 16 and the cylinder 14. Inlet 20 is connected to a series of inlet ports 21 which are disposed partially around cylinder 14. Exhaust 22 is connected to communicate with a series of exhaust ports 23 formed in cylinder 14. Transfer passage 24 is connected at its lower end to openings 25 formed in crankcase 16 and at its upper end to transfer ports 26 formed in cylinder 14.

Figure 3:
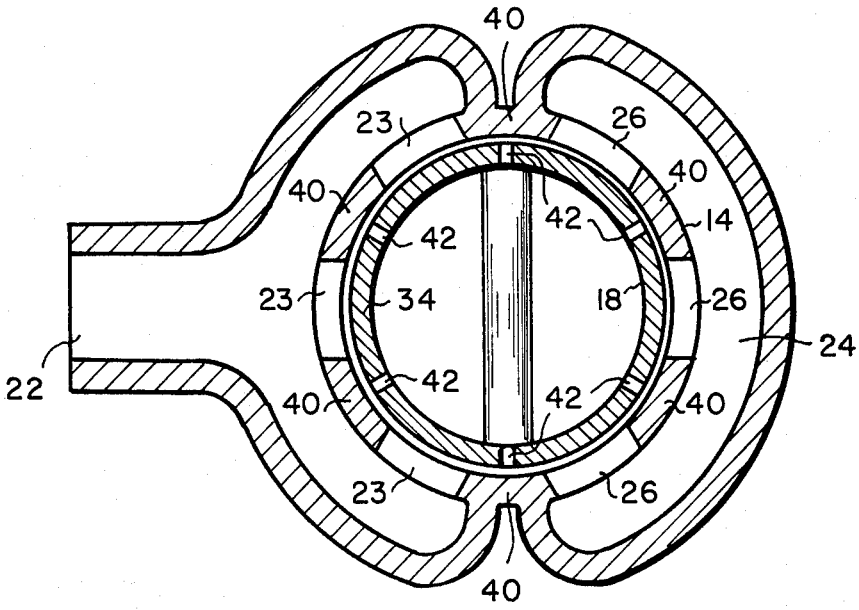
FIG. 3 is a top sectional view along the line III—III.
Figure 7:
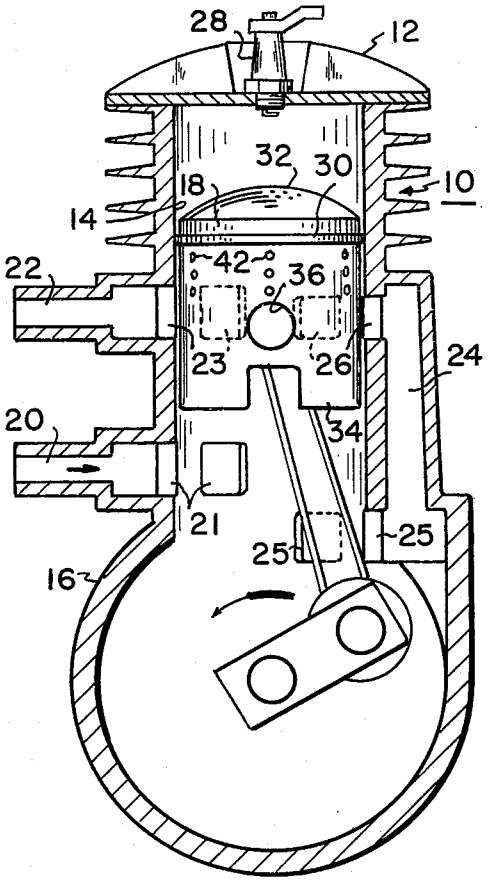
FIG. 7 is similar to FIG. 5 but with the piston in an intermediate position.
Figure 6:
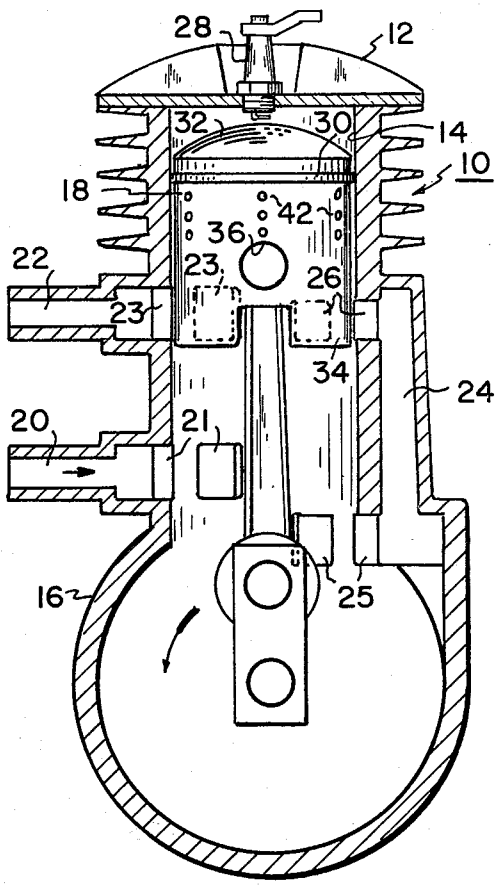
FIG. 6 is similar to FIG. 5 with the piston in the top position.
Figure 5:
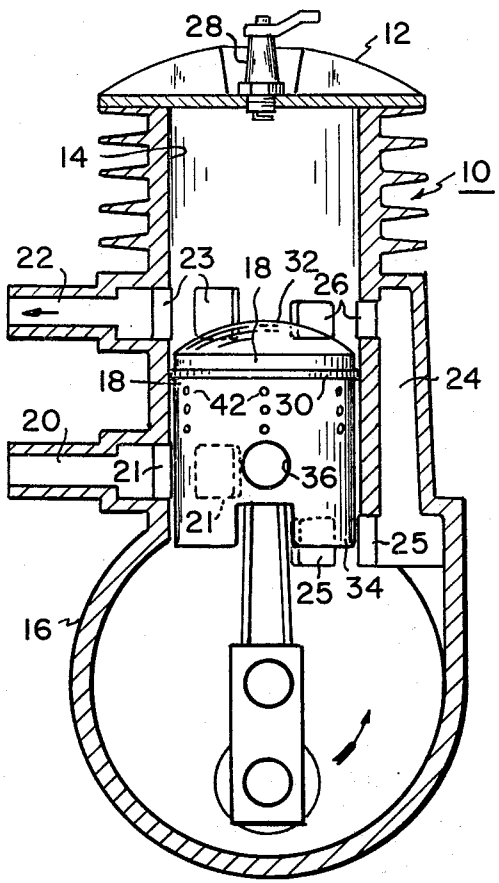
FIG. 5 is a view of a portion of the engine shown in FIG. 1 with the piston in the bottom position.

During normal operation as piston 18 moves upward, as shown in FIG. 7, a partial vacuum is produced in crankcase 16, until the lower edge of piston 18 passes the inlet ports 21. As the lower portion of piston 18 passes inlet ports 21, a fuel-air mixture is drawn through inlet 20 into crankcase 16. As piston 18 continues to rise the fuel-air mixture trapped in cylinder 14 above exhaust ports 23 is compressed. At the proper instant when the piston 18 is near the top dead center position an electric potential placed upon spark plug 28 ignites the fuel-air mixture causing it to expand and this forces the piston 18 downward. As the piston 18 travels downward outlet ports 23 are uncovered permitting the hot burnt high pressure gases to exit through exhaust 22. As piston 18 continues downward transfer ports 26 are uncovered permitting the fresh fuel-air mixture trapped in crankcase 16 to enter cylinder 14. The transfer ports 26 are designed and constructed to help force out any burnt gases remaining in the cylinder 14 when the fresh charge enters. When piston 18 travels downward and closes inlet ports 21, the fuel-air mixture in crankcase 16 is compressed slightly to force it to flow through transfer passage 24 into cylinder 14. As the piston 18 continues to travel it reaches bottom center where it is stopped and again moves upward repeating the above described cycle. Sealing rings 30 are provided on piston 18 during operation. Inlet ports 21, exhaust ports 23 and transfer ports 26 are formed in cylinder 14 in a circumferentially spaced but vertically aligned manner, so that continuous vertical portions or ribs 40 are present in the inner cylinder wall of cylinder 14. This can best be seen in FIG. 3 where the vertical continuous portion or ribs 40 are clearly shown.

Figure 4:
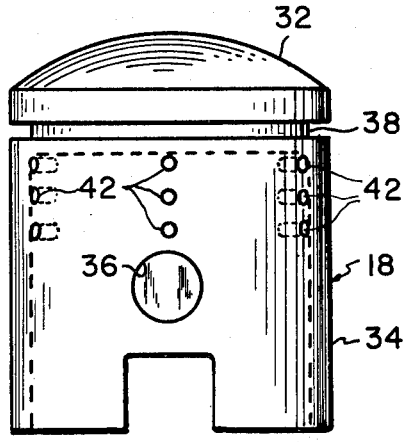
FIG. 4 is a side view of a piston utilizing the teaching of the present invention.

Referring now to FIGS. 1 and 4, there is shown a piston 18 utilizing the teaching of the present invention. Piston 18 comprises a piston head 32 and a solid piston skirt 34 extending therefrom. Openings 36 for receiving a connecting rod which is connected to the drive assembly during operation is provided in the skirt 34. A groove 38 is provided around piston 18 for receiving a sealing ring 30. Small diameter bores 42 are formed through skirt 34 below the annular sealing ring groove 38. These bores 42 are normally formed in 180° spaced apart pairs. Bores 42 are of a relatively small diameter as compared with the areas of the ports 21, 23 and 26. When cylinder 18 is installed in a two-stroke engine 10 as shown in FIGS. 1, 5, 6 and 7, the bores 42 are aligned to register with the vertical ribs 40 in cylinder 14. During normal operation with piston 18 installed in engine 10 the solid skirt 34 is generally parallel with the inner cylinder wall of cylinder 14. Bores 42 thus extend through skirt 34 substantially perpendicular to cylinder wall 14. Thus as piston 18 reciprocates up and down during operation the bores 42 reciprocate up and down along the vertical rib portions 40 of cylinder 14. As piston 18 reciprocates within cylinder 14, the bores 42 cause a hydrostatic-type bearing to be formed between piston skirt 34 and the vertical ribs 40. This substantially reduces internal friction and wear providing for cooler operation of engine 10. This permits engine 10 to be operated at a higher speed without any deleterious effects.

As shown in FIGS. 1 and 4, more than one set of circumferentially spaced bores 42 can be utilized. Additional sets of circumferentially spaced bores 42 can be vertically separated. Bores 42 are formed in cylinder 18 to align with the vertical ribs 40 and to insure equal balanced loading in all four quadrants on piston 18. It has been determined experimentally that six bores circumferentially spaced around skirt 34 provide excellent operation and loading on piston 18. Additional sets of bores 42 can be formed as desired. As the piston reciprocates, the holes aligned with the vertical ribs to permit the fuel-air mixture in the crankcase to form the hydrostatic-type bearing surface between the piston and the cylinder wall. This hydrostatic-type bearing drastically reduces friction, piston wear, and cylinder wear, resulting in substantially lower operating temperatures and increased volumetric efficiency. The lower operating temperatures and decreased wear provide for longer component life than in prior art engines.

As can be seen from the above description, the disclosed invention has the advantage of reducing operating temperature of the piston and cylinder in a two-stroke internal combustion engine. This reduced temperature provides for more efficient operation and permits higher RPM's to be obtained.

What is claimed is:

1. A two stroke internal combustion engine comprising:

a cylinder having a plurality of continuous vertical rib portions with a plurality of port openings disposed therebetween, the inner most portion of the ribs forming the inner most portion of the cylinder wall;

a piston supported for reciprocating longitudinal movement within said cylinder comprising a head portion and a skirt portion extending from the head portion;

at least one annular groove for receiving a sealing ring formed at the upper end of the piston skirt;

sealing ring means secured by said at least one annular groove for providing a seal between said cylinder and said piston; and a plurality of bores through the skirt portion located beneath the head portion lower than said at least one annular groove and said sealing ring means with each bore being directed perpendicular at, and opening in close proximity to one of said vertical rib portions to cause a hydrostatic type bearing between the piston and the cylinder wall.

2. A two stroke internal combustion engine as claimed in claim 1 wherein:

said skirt portion is solid and generally parallel with the inner wall of said cylinder; and said plurality of bores are uniformly spaced circumferentially around said piston skirt.

3. A two stroke internal combustion engine as claimed in claim 2 wherein said piston comprises:

an additional plurality of bores circumferentially spaced around said piston skirt and vertically aligned with said first plurality of bores.

4. A two stroke internal combustion engine comprising:

a cylinder having a hollow circular inner wall portion with a plurality of continuous vertical rib portions defining the inner most portion of the cylinder wall, and a plurality of ports disposed between the vertical rib portions;

a piston disposed in said cylinder for reciprocating motion having a head and a solid skirt depending from the periphery of said head;

sealing means disposed around said skirt in proximity to said head;

said skirt extending parallel to the hollow circular inner wall portion of said cylinder and having a plurality of spaced apart bores formed therethrough; and said plurality of spaced apart bores extending generally perpendicular to the continuous vertical rib portions, with each opening in proximity to one of the continuous vertical rib portions, and being disposed uniformly along a circumference around said skirt, which circumference is spaced away from said sealing means toward the end of said skirt not connected to said head.

5. A two stroke internal combustion engine as claimed in claim 4 wherein:

at least six vertical ribs are formed in said cylinder; and at least six bores are formed through said skirt.

6. A two stroke internal combustion engine as claimed in claim 5 comprising an additional set of circumferentially spaced bores vertically separated from said first set of circumferentially spaced bores.

7. A piston for an internal combustion engine having a cylinder formed with a plurality of vertical rib portions defining the inner most position of the cylinder wall, said piston comprising:

a piston head;

a solid piston skirt extending perpendicular from the periphery of said piston head;

at least one annular groove formed in said piston skirt below said piston head for receiving sealing rings; and a plurality of circumferentially spaced apart holes of a relatively small uniform diameter formed below said at least one annular groove and extending generally perpendicular, through said piston skirt and which, when the piston is inserted in the cylinder, extend in close proximity to the plurality of vertical rib portions, to permit formation of a hydrostatic type bearing between the piston and cylinder wall during operation of the internal combustion engine.

8. A two stroke internal combustion engine comprising:

a cylinder wall having a first set of circumferentially spaced apart ports formed therein and a second set of circumferentially spaced apart ports formed therein which are vertically aligned with said first set of circumferentially spaced apart ports to define a plurality of vertical continuous portions which form the inner most portion of the cylinder wall;

a piston having a closed end and an open end disposed within said cylinder wall having a plurality of spaced apart holes formed therein;

each of said plurality of holes extending generally perpendicular through the piston skirt and disposed so as to be circumferentially spaced from the vertically aligned ports and aligned with one of said vertical continuous portions;

said piston having at least one annular groove formed therearound for receiving a sealing ring; and said plurality of holes being of a small diameter and spaced apart from the annular groove in said piston toward the open end.

* * * * *